United States Patent [19]

Afzali-Ardakani et al.

[11] Patent Number: 4,810,119

[45] Date of Patent: Mar. 7, 1989

[54] RESISTIVE RIBBON FOR HIGH RESOLUTION PRINTING

[75] Inventors: Ali Afzali-Ardakani, White Plains, N.Y.; Ronald T. Cannavaro, Danbury, Conn.; Walter Crooks, Los Gatos, Calif.; Mukesh Desai, Fishkill, N.Y.; Keith S. Pennington, Somers, N.Y.; Jean-Piet Hoekstra, Carmel, N.Y.; Eva E. Simonyi, Bronx, N.Y.

[73] Assignee: International Business Machines Corporation, Armonk, N.Y.

[21] Appl. No.: 115,453

[22] Filed: Oct. 30, 1987

[51] Int. Cl.[4] ..... B41J 31/06

[52] U.S. Cl. ..... 400/241.1; 400/120; 346/76 PH; 427/148; 427/278; 428/913

[58] Field of Search ..... 400/241.1, 241, 241.4, 400/120; 346/76 PH; 428/913, 914; 427/271, 278, 279, 148

[56] References Cited

U.S. PATENT DOCUMENTS

| | | | |
|---|---|---|---|
| 1,830,559 | 11/1931 | Pelton | 400/241 |
| 1,971,306 | 8/1934 | Gutrim | 400/291 X |
| 3,080,954 | 3/1963 | Newman et al. | 400/241.4 X |
| 3,205,998 | 9/1965 | Sperry et al. | 400/241.4 X |
| 3,706,276 | 12/1972 | Yamada et al. | 427/140 X |
| 4,308,633 | 1/1982 | Van Huffel et al. | 427/148 X |
| 4,309,117 | 1/1982 | Chang et al. | 400/241.1 |
| 4,491,431 | 1/1985 | Aviram et al. | 400/241.1 |
| 4,560,578 | 12/1985 | Freeman | 427/278 X |
| 4,581,283 | 4/1986 | Tokunaga et al. | 400/241.1 X |
| 4,678,701 | 7/1987 | Pennington et al. | 400/241.1 X |
| 4,699,533 | 10/1987 | Crowe et al. | 400/241.1 |
| 4,704,304 | 11/1987 | Amendola et al. | 427/148 X |

*Primary Examiner*—Edgar S. Burr
*Assistant Examiner*—James R. McDaniel
*Attorney, Agent, or Firm*—Sughrue, Mion, Zinn, Macpeak, and Seas

[57] ABSTRACT

An improved thermal transfer resistive ribbon usable in high resolution printing comprising a dual resistive layer formed of a first layer of low resistivity and a second layer of high resistivity, method of production thereof, use thereof and apparatus including the same.

22 Claims, 2 Drawing Sheets

RESISTIVE RIBBON FOR HIGH RESOLUTION PRINTING

FIELD OF THE INVENTION

This invention relates to thermal printing techniques and apparatus and more particularly to an improved thermal transfer resistive ribbon characterized by different resistivities in the horizontal and vertical directions, use thereof in high resolution printing and production thereof.

BACKGROUND ART

Both resistive ribbon thermal transfer printing and electroerosion printing are known in the art for providing acceptable resolution, good quality printing, especially of the type that is used in computer terminals and typewriters. Resistive ribbon thermal transfer printing is a type of thermal transfer printing in which a thin ribbon is used. The ribbon is generally comprised of either three or four layers, including a layer of fusible ink that is brought into contact with the receiving medium (such as paper), and a layer of electrically resistive material. In a variation, the resistive layer is thick enough to be the support layer, so that a separate support layer is not needed. A thin, electrically conductive layer is also optionally provided to serve as a current return.

In order to transfer ink from the fusible ink layer to the receiving medium, the layer of ink is brought into contact with the receiving surface. The ribbon is also contacted by an electrical power supply and selectively contacted by a thin printing stylus at those points opposite the receiving surface (paper) where it is desired to print. When current is applied via the thin printing stylus, it travels through the resistive layer and causes localized resistive heating which in turn melts a small volume of ink in the fusible ink layer. This melted ink is then transferred to the receiving medium to produce printing. Resistive ribbon thermal transfer printing is described in U.S. Pat. Nos. 3,744,611; 4,309,117; 4,400,100; 4,491,431; and 4,491,432.

The materials used in resistive printing ribbons are well known in the art. For example, the resistive layer is commonly a carbon or graphite-filled polymer, such as polycarbonate. The thin current return layer is a metal, such as Al. The thermally fusible inks are comprised of various resins having a colorant therein, and typically melt at about 100 degrees C. Printing currents of approximately 20–30 mA are used in the present, commercially available printers, such as those sold by IBM Corporation under the name QUIETWRITER TM.

Electroerosion printing is also well known in the art. as exemplified by U.S. Pat. Nos. 3,786,518; 3,861,952; 4,339,758; and 4,086,853, Electroerosion printing is known as a technique which is suitable to make direct offset masters and direct negatives, Generally, the electroerosion recording medium is comprised of a support layer and a thin conductive layer. The support layer can be, for example, paper, polyesters such as Mylar TM etc., while the thin conductive layer is a metal, such as A1. In order to print, portions of the thin A1 layer are removed by an electric arc. To do so, a printing head comprising multiple styli, typically tungsten wire styli of diameters 0.3–0.5 mil, is swept across the electroerosion medium while maintaining good electrical contact between the styli tips and the aluminum layer. When an area is to be printed, a pulse is applied to the appropriate styli at the correct time, resulting in an arc between the energized styli and the aluminum layer. This arc is hot enough to cause local removal of the aluminum by disintegration, e.g., vaporization.

Practical electroerosion media require a base layer between the supporting substrate and the thin metal layer, as well as an overlayer on the thin metal layer. The base layer and the overlayer are used to prevent scratching of the aluminum layer in areas where no arc is applied, and to minimize head wear and fouling. Typically, the base layer is a hard layer consisting of hard particles embedded in a suitable binder, such as silica in a cross-linked cellulosic binder. The overlayer is typically a lubricating, protective overlayer comprised of a polymer including a solid lubricant, such as graphite in a cellulosic binder.

Each stylus of a commercial multi-stylus recording head used with resistive ribbon thermal transfer printing apparatus will have a diameter of about 1 to 4 mil, usually about one mil, particularly when used with the printer sold by IBM Corporation under the name QUIETWRITER TM. For high resolution printing, the size of a corresponding dot comprising ink transferred to a receiving substrate such as paper should be as close to the actual size of the stylus head as possible, that is about 1 mil in diameter. However, in practice, dot size is often as large as 4 mils in diameter using 1 mil styli. To a significant extent, the increase in dot size over stylus size is due to the thickness of the resistive layer in conventional self-supporting thermal transfer resistive ribbons, where the resistive layer, being a layer of 15 to 20 micron thick carbon-filled polycarbonate, also serves a support function. Considerable lateral heating of the resistive layer occurs, consequently increasing dot size. The 15 to 20 micron thick resistive layer has been considered necessary for maintenance of physical integrity of the resistive layer during the printing process, in the absence of a separate support. One approach considered to produce a resistive: thermal transfer ribbon providing higher resolution printing was to reduce the thickness of the resistive layer through a calendering operation whereby better carbon particle to particle contact would allow lowering the percent carbon loading, in turn resulting in a thinner resistive layer of higher mechanical strength. Calendering techniques for use with typewritter type ribbons are known, for example, see U.S. Pat. No. 1,830,559 to Pelton. Another approach was to provide a single resistive layer having an anistropic character so that the resistance is less in the direction of thermal transfer for printing than in the lateral direction. This approach is difficult to practice. Thus, thermal ribbon printing and production methods, and resistive ribbon products, are sought which will provide higher resolution printing when used with small diameter multi-stylus recording heads.

SUMMARY OF THE INVENTION

Accordingly, it is a primary object of this invention to provide an improved thermal transfer resistive ribbon.

It is another object of this invention to provide a thermal transfer resistive ribbon providing high resolution printing.

Still another object of this invention is to provide a process for producing an improved, anistropic thermal transfer resistive ribbon.

It is another object of this invention to provide a printing process whereby low levels of electrical energy are used to directly cause high resolution printing.

It is yet another object of this invention to improve the resolution of printing obtainable with resistive ribbon transfer printing equipment.

It is another object of this invention to provide a multi-stylus recording head ink transfer printing process in which transferred printed dot size is about the same size as stylus diameter.

Other objects of this invention will be apparent to the skilled artisan from the detailed description of the invention hereinbelow.

Accordingly, the present invention provides an anistropic thermal transfer resistive ribbon in which areas of reduced resistivity are provided in a vertical printing direction, whereby resolution of transfer dots is improved. More particularly, the present invention provides a thermal transfer resistive ribbon comprising a dual resistive layer formed of a first low resistivity layer, and a second layer of higher resistivity. In a preferred embodiment said low resistivity layer is calendered and grooved, and the second higher resistivity layer fills the grooves of said first low resistivity layer.

In another aspect of the present invention, there is disclosed a process for producing a thermal transfer resistive ribbon providing improved dot size resolution.

In another aspect of the present invention there is provided an apparatus for recording including the improved ribbon disclosed herein, and a printing process utilizing said improved ribbon.

In preferred embodiments of this invention, the layer of lower resistivity has a resistivity in the range of about 50–400 ohm/sq and the layer of higher resistivity has a resistivity in the range of about 1000 to 5000 ohm/sq.

In another preferred embodiment of this invention, the peak to valley distance in the grooves is about 3 to 5 microns and the peak to peak distance is about 10 to 25 microns.

DETAILED DESCRIPTION OF THE INVENTION

In this invention, a multi-stylus printing head, of the type used in resistive ribbon printing or electroerosion printing, is used to provide localized currents in a resistive layer of a thermal ink transfer ribbon. The ink transfer ribbon is comprised of a dual resistive layer, a thin conductive metal layer and an uppermost fusible ink layer.

Figure 1:
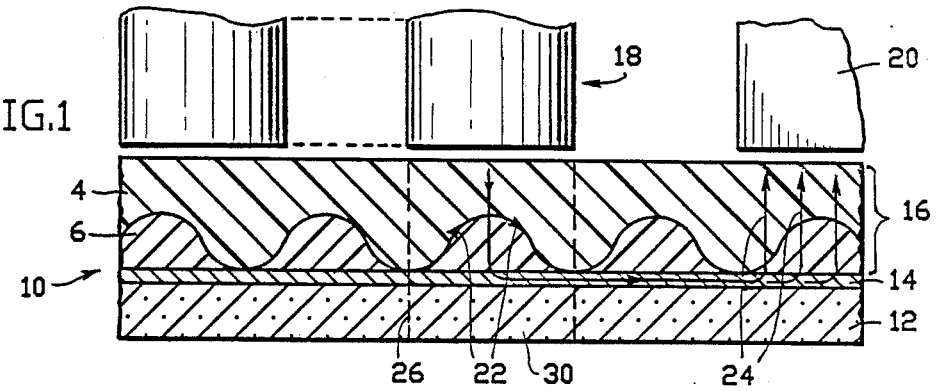
FIG. 1 depicts a transfer apparatus of the present invention, where an electrical current from a printing stylus passes through a dual resistive layer and causes ink above said resistive layer to melt.

FIG. 1 shows an apparatus for practicing the present invention where the ribbon 10 is comprised of a dual resistive layer 16, conductive metal layer 14 and fusible transfer ink layer 12. In order to direct electrical currents into the resistive layer 16. thereby heating the resistive layer which in turn locally transfers heat through the metal layer 14 to fusible ink layer 12, a multi-stylus head of the type used in either resistive ribbon printing or electroerosion printing is provided. This type of head is well-known in the art and is comprised of a plurality of printing styli 18 and a large contact (ground) electrode 20. When a select pattern of printing styli 18 is energized, electrical currents, represented by the arrows 22 will flow through the resistive layer and return to the ground electrode 20 via the metal conductive layer 14, as represented by arrows 24. If the current density is sufficiently high in the resistive layer region in the vicinity of the printing stylus 18. intense resistive heating will occur in a small region 26 of the resistive layer 16 and sufficient heat will be conducted through the metal conductive layer to coextensive fusible ink region 30, to melt and sufficiently soften ink region 30 so that it will transfer to a receptor layer, such as a paper sheet. Currents of about 10 to 50, preferably about 20 to 30 mA are usable within the concepts of the present invention. The electrical current pulses will have durations of about 1 to 100 msec. In this invention, resistive layer 16 is formed of low resistivity layer 4 and high resistivity layer 6.

In FIG. 2, where found, the reference numerals 4, 6. 12, 14 and 16 depict the same elements as in FIG. 1.

Figure 2A:
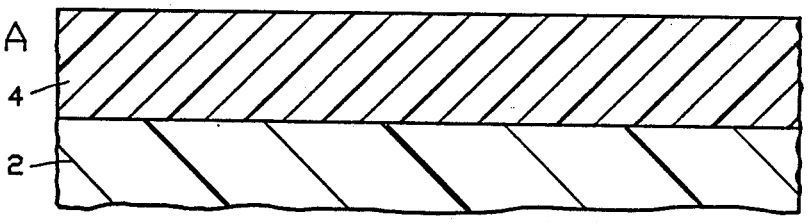
FIGS. 2(A) through 2(E) depict intermediate material cross-sections occurring in a production sequence of the inventive thermal transfer resistive ribbon 2(F) of this invention.

In FIG. 2(A), low resistivity layer 4 has been deposited on substrate 2 using standard coating technology. The substrate or support 2 can be any of the materials generally considered for use as a support during production of thermal transfer resistive ribbons, including Mylar TM (polyethylene terephthalate). Teflon TM (polytetrafluoroethylene), other polyesters, etc.

Low resistivity layer 4 can be fabricated by depositing a coating layer of a dispersion of conductive particles in a thermoplastic binder to provide the low resistivity layer. The conductive particles and thermoplastic binder are used as known in the art of formation of thermal transfer resistive ribbons. For example, the conductive particles can be selected from carbon. graphite, metal powder (such as nickel powder), nickel coated mica, and the like, while the thermoplastic binder can be selected from polycarbonates, polyimides. polyetherimides, polysulfones, and so on. The amount of conductive particle loading is selected so as to provide a layer having a resistivity in the range of about 50 to 400 ohm/sq, preferably about 100 to 200 ohm/sq. A suitable conductive particle loading will often be in the range of about 10 to 40 wt, depending upon the specific conductive particles selected, for example, 25 to 30 with use of carbon particles of size of about 0.1 to 1 micon. One of average skill in the art can readily determine suitable concentrations through routine experimentation. This first resistive layer can be coated to a thickness of about 5 to 15 microns on the substrate.

Figure 2B:
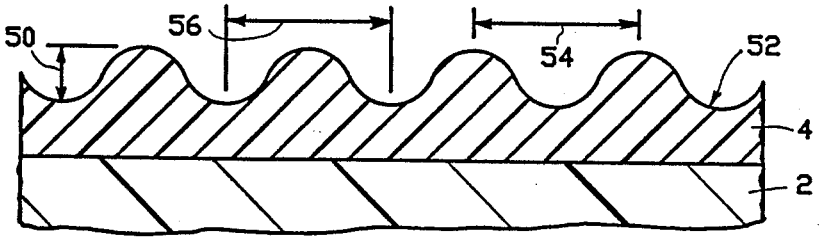

Following coating and drying, the low resistivity layer is preferably calendered and embossed, usually in a single process step employing a grooved roller. Of course, separate calendering and engraving steps can be employed. The embossing is carried out so that the peak to valley distance 50 as shown in FIG. 2(B) of the embossed grooves 52 is about 1 to 10 microns. preferably about 3 to 5 microns. The peak to peak (center to center) distance 54 is about 5 to 50 microns. preferably about 10 to 25 microns. The center valley to center valley distance 56 is about 5 to 50 microns, preferably about 10 to 25 microns. Most preferably the distance 54 is the same as stylus diameter. An embossing roll to provide the desired surface pattern can be selected since its pattern will approximately be that opposite to the engraving desired in the low resistivity layer. The engraving can conveniently be carried out near or higher than the glass transition temperature of the thermoplastic binder, under a pressure sufficient to provide the desired pattern. For example, with a polycarbonate-carbon layer, temperatures of about 120 to 150° C. and pressure of about 2000 to 6000 Psi can be employed.

Figure 2C:
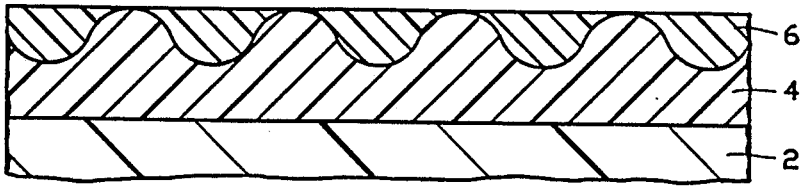

Thereafter, the layer of higher resistivity is coated over layer 4 at a thickness approximately sufficient to fill the grooves 52, that is, to a depth about equal to distance 50, as shown in FIG. 2(C). The conductive particle and binder ingredients of the coating composition for the high resistivity layer can be selected from those usable for the low resistivity layer. The degree of conductive particle loading is selected so that high resistivity layer 6 has a resistance of about 1000 to 5000 ohm/sq, preferably about 1000 to 2000 ohm/sq. Thus, if the same ingredients are used to form layer 6 as used in layer 4, the degree of particle loading will be significantly less, say about 15 to 20% carbon in a polycarbonate binder. At this point, dual resistive layer 16 has been prepared.

Figure 2D:
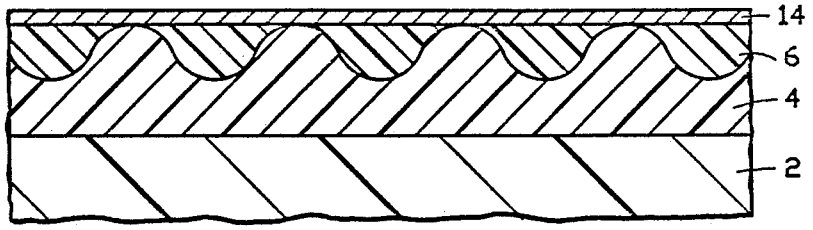
Figure 2E:
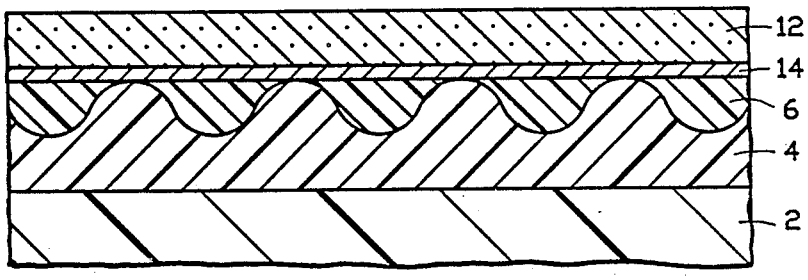

After the formation of dual resistive layer 16, thin metal conductive layer 14 (FIG. 2(D)) and fusible ink layer 12 (FIG. 2(E)) are applied using conventional resistive ribbon thermal transfer technology. Thus, evaporation processes, such as vacuum evaporation, sputtering, electroless plating or metal electroplating can be used to provide thin metal conductive layer 14. Usable metals include nickel, copper, gold, aluminum, chromium and so on. This thin conductive metal layer will usually be of thickness of 500 to 1000 Å, this being the preferred thickness where aluminum is provided by vacuum evaporation.

Figure 2F:
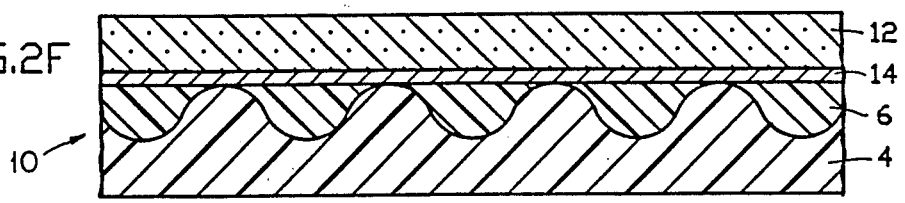

Finally, an ink layer 12 which consists of a dispersion of a pigment and/or dye in a wax or low melting organic polymer combination thereof, is coated on top of the thin metal layer, usually to a thickness of about 2 to 5 microns. At this point, the ribbon is delaminated from the substrate 2 as known in the art, to provide the completed ribbon structure as shown in FIG. 2(F) of the drawing.

The preparation of a resistive ribbon as described herein, as noted above, does not require the inclusion of an internal support separate from the resistive layer for use thereof, since the dual resistive layer will provide sufficient physical integrity. Naturally, the concept of this invention can be employed with ribbons having a separate internal support.

When an electric current is applied to the ribbon of the present invention, as illustrated in FIG. 1, the electric current will choose the lowest resistance path. Thus, the current will flow through the low resistivity layer to the thin metal conductive layer without spreading to the high resistivity region of the second layer. As a result, heat is generated only in the region of the electric path, which in turn results in the transfer of a small dot of ink from the fusible ink layer to a substrate. By having the electric current directed though the high conductivity path formed through the low resistivity layer to the metal conductive layer, an area surrounding the stylus is not heated, which results in the transfer of an ink dot of a diameter about the same as the stylus diameter, without loss of resolution. Thus, the anistropic ribbon of this invention provides high resolution printing.

Variations of the invention will be apparent to the skilled artisan.

What is claimed:

1. An apparatus for recording, comprising:

a recording medium comprised of an anistropic resistive dual layer characterized by areas of low resistivity in the direction of heat transfer for printing, a thin electrically conductive layer over said resistive layer serving as an electrical current return path and a fusible ink layer as an uppermost layer, said resistive dual layer comprising a first layer of low resistivity remote from said conductive layer and a second layer of high resistivity adjacent said conductive layer said low resistivity layer having a continuous series of alternating, substantially uniform valleys and peaks across the surface thereof, said valleys being essentially completely filled by said high resistivity layer having a thickness substantially the same as the peak to valley distance; and a multi-stylus recording head for providing patterns of electrical current through selected regions of said resistive layer, where said electrical currents are localized in the regions of said resistive layer contacted by the styli which were energized by said electrical currents, said localized electrical currents being sufficiently dense to provide sufficient resistive heating to heat regions of said fusible ink layer about coextensive with said selected regions of said resistive layer sufficient to soften said regions of said ink layer for transfer to a receiving surface.

2. The apparatus of claim 2 wherein the resistive layer is a dual resistive layer comprising a low resistivity layer that has been calendered and embossed.

3. The apparatus of claim 1 wherein the peak to valley distance is about 1 to 10 microns and the peak to peak distance is about 5 to 50 microns.

4. The apparatus of claim 3 wherein the center valley to center valley distance is about 5 to 50 micron.

5. The apparatus of claim 4 wherein the peak to valley distance is about 3 to 5 microns, the peak to peak distance is about 10 to 25 microns and the center valley to center valley distance is about 10 to 25 microns.

6. The apparatus of claim 1 wherein the low resistivity layer has a resistivity of about 50 to 400 ohm/sq and the high resistivity layer has a resistivity of about 1000 to 5000 ohm/sq.

7. The apparatus of claim 6 wherein the low resistivity layer has a resistivity of about 100 to 200 ohm/sq and the high resistivity layer has a resistivity of about 1000 to 2000 ohm/sq.

8. A thermal transfer resistive ribbon comprised of an anistropic resistive dual layer characterized by areas of low resistivity in the direction of heat transfer for printing, a thin electrically conductive layer over said resistive layer serving as an electrical current return path and a fusible link layer as an uppermost layer, said resistive dual layer comprising a first layer of low resistivity remote from said conductive layer and a second layer of high resistivity adjacent said conductive layer said low resistivity layer having a continuous series of alternating, substantially uniform valleys and peaks across the surface thereof, said valleys being essentially completely filled by said high resistivity layer having a thickness substantially the same as the peak to valley distance.

9. The thermal transfer resistive ribbon of claim 8 wherein the resistive layer is a dual resistive layer comprising a low resistivity layer that has been calendered and embossed.

10. The thermal transfer resistive ribbon of claim 8 wherein the peak to valley distance is about 1 to 10 microns and the peak to peak distance is about 5 to 50 microns.

11. The thermal transfer resistive ribbon of claim 10 wherein the center valley to center valley distance is about 5 to 50 microns.

12. The thermal transfer resistive ribbon of claim 11 wherein the peak to valley distance is about 3 to 5 microns, the peak to peak distance is about 10 to 25 microns and the center valley to center valley distance is about 10 to 25 microns.

13. The thermal transfer resistive ribbon of claim 8 wherein the low resistivity layer has a resistivity of about 50 to 400 ohm/sq and the high resistivity layer has a resistivity of about 1000 to 5000 ohm/sq.

14. The thermal transfer resistive ribbon of claim 13 wherein the low resistivity layer has a resistivity of about 100 to 200 ohm/sq and the high resistivity layer has a resistivty of about 1000 to 2000 ohm/sq.

15. An improved method for high resolution printing in which a fusible ink image is transferred to a receiving substrate, which method comprises:

providing a fusible ink transfer medium comprising a resistive layer, a thin electrically conductive layer over said resistive layer and a fusible ink layer as an outermost layer remote from said resistive layer, said resistive layer being a dual resistive layer comprising a first layer of low resistivity remote from said conductive layer and a second layer of high resistivity adjacent said conductive layer said low resistivity layer having a continuous series of alternating, substantially uniform valleys and peaks across the surface thereof, said valleys being essentially completely filled by said high resistivity layer having a thickness substantially the same as the peak to valley distance;

locating a multi-stylus recording head capable of providing electrical current pulses in selected ones of said recoding styli in contact with said resistive layer applying electrical current pulses through selected ones of said recording styli to produce high density localized currents in the regions of said resistive layer in contact with said selected energized styli, said electrical currents providing resistive heating in the regions of said thin electrically conductive layer about coextensive with said resistive layer regions;

contacting said fusible ink layer with said receiving substrate while providing sufficient heating by means of said resistive heating in the regions of said thin electrically conductive layer about coextensive with said resistive layer regions to soften regions of said fusible ink layer about coextensive with said resistive layer regions to transfer said coextensive regions of said fusible ink layer to said receiving substrate.

16. The method of claim 15 wherein the resistive layer is a dual resistive layer comprising a low resistivity layer that has been calendered and embossed.

17. The method of claim 15 wherein the peak to valley distance is about 1 to 10 microns and the peak to peak distance is about 5 to 50 microns.

18. The method of claim 17 wherein the center valley to center valley distance is about 5 to 50 micrors.

19. The method of claim 18 wherein the peak to valley distance is about 3 to 5 microns the peak to peak distance is about 10 to 25 microns and the center valley to center valley distance is about 10 to 25 microns.

20. The method of claim 15 wherein the low resistivity layer has a resistivity of about 50 to 400 ohm/sq and the high resistivity layer has a resistivity of about 1000 to 5000 ohm/sq.

21. The method of claim 20 wherein the low resistivity layer has a resistivity of about 100 to 200 ohm/sq and the high resistivity layer has a resistivity of about 1000 to 2000 ohm/sq.

22. The method for preparing a thermal transfer resistive ribbon comprising:

(1) depositing a thermal transfer resistive ribbon low resistivity layer having a resistivity of about 50 to 400 ohm/sq on a substrate;

(2) calendering and embossing said low resistivity layer to form a continuous series of alternating substantially uniform valleys and peaks across the surface thereof;

(3) coating a layer of higher resistivity over said layer of low resistivity to a thickness of approximately sufficient to fill said valleys, the layer of higher resistivity having a resistivity of about 1000 to 5000 ohm/sq;

(4) applying a thin electrically conductive layer over said layer of higher resistivity (5) applying a thermal transfer resistive ribbon fusible ink layer over said thin metal layer to form a thermal transfer resistive ribbon on said substrate and (6) separating said thermal transfer resistive ribbon from said substrate.

* * * * *